US008459170B2

(12) United States Patent
Adorni et al.

(10) Patent No.: US 8,459,170 B2
(45) Date of Patent: Jun. 11, 2013

(54) VEHICLE PROVIDED WITH REVOLVING TURRET

(75) Inventors: Andrea Adorni, La Spezia (IT); Andrea Chiappini, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 41 days.

(21) Appl. No.: 12/721,328

(22) Filed: Mar. 10, 2010

(65) Prior Publication Data

US 2011/0219944 A1 Sep. 15, 2011

(51) Int. Cl.
*F41H 5/20* (2006.01)

(52) U.S. Cl.
USPC ..... 89/36.13

(58) Field of Classification Search
USPC ..... 89/36.07, 36.08, 36.09, 36.13, 36.14
See application file for complete search history.

(56) References Cited

U.S. PATENT DOCUMENTS

| | | | | |
|---|---|---|---|---|
| 2,559,714 | A * | 7/1951 | Duplessis | 89/37.01 |
| 3,559,527 | A * | 2/1971 | Schallehn | 89/36.08 |
| 4,583,444 | A * | 4/1986 | Jackson | 89/36.13 |
| 5,056,409 | A * | 10/1991 | Allais et al. | 89/37.01 |
| 5,663,520 | A * | 9/1997 | Ladika et al. | 296/187.07 |
| 2005/0188831 | A1 | 9/2005 | Squires et al. | |

FOREIGN PATENT DOCUMENTS

| | | |
|---|---|---|
| EP | 1 061 323 | 12/2000 |
| EP | 1 508 765 | 2/2005 |

OTHER PUBLICATIONS

Definition of "Tank". The American Heritage® Dictionary of the English Language, Fourth Edition copyright © 2000 by Houghton Mifflin Company. Updated in 2009. Published by Houghton Mifflin Company. All rights reserved.*

Definition of "Overhead". The American Heritage® Dictionary of the English Language, Fourth Edition copyright © 2000 by Houghton Mifflin Company. Updated in 2009. Published by Houghton Mifflin Company. All rights reserved.*

Definition of "Base". The American Heritage® Dictionary of the English Language, Fourth Edition copyright © 2000 by Houghton Mifflin Company. Updated in 2009. Published by Houghton Mifflin Company. All rights reserved.*

Overhead Remote Controlled Weapon Stations, *Elbit Systems Land and C⁴I*, www.elbitsystems.com/landc4i.

* cited by examiner

*Primary Examiner* — Gabriel Klein
(74) *Attorney, Agent, or Firm* — Merchant & Gould P.C.

(57) ABSTRACT

A vehicle provided with a revolving turret includes an armor-plated cockpit (2), a system for the motion of the central revolving turret (4) upon which a main armament (5) can be mounted. The turret is connected to the armor-plated cockpit of the vehicle of a circumferential fifth-wheel (8) which allows the revolving of the turret around a substantially vertical axis which passes through the center of the fifth-wheel. The base (9) of the turret presents a hatch (10) for communication between the interior of the turret and the interior of the cockpit (2) of the vehicle.

5 Claims, 2 Drawing Sheets

VEHICLE PROVIDED WITH REVOLVING TURRET

BACKGROUND

The present invention relates to a vehicle, for instance a tracked vehicle or a rotated vehicle of military type, provided with revolving turret with artillery.

BACKGROUND

To the state of the art are known armored vehicles movable by a system of tracks and provided with a central revolving turret upon which is mounted the main armament of the truck which is usually a cannon. This cannon is provided with thermal sensors and usually has a system for the gas recovery and fire damping and is also hydraulically and/or electrically stabilized.

The turret is also usually provided with one or more machine guns and with various pointing and vision systems, such as a stabilized night/day periscopic viewer for the commander, a stabilized viewer with thermal view and laser telemeter for the gunner, apart from a fire controlling computer. The computer receives data from the various sensors of the vehicle and is able to process all the data for determining the best firing conditions.

Normally, in these types of vehicles, classified as tanks, or combat vehicles or troops transport vehicles, the interior where there is the position of the pilot and the interior of the turret are separated, for safety reasons.

SUMMARY

The present invention relates to a vehicle provided with a revolving turret with armament which communicates with the interior of the vehicle through an emergency hatch, preferably armor-plated, which opens at the bottom or the basis of the turret toward the interior of the armor-plated vehicle.

An aspect of the present invention relates to a vehicle provided with revolving turret.

BRIEF DESCRIPTION OF THE DRAWINGS

The characteristics and the advantages of the vehicle according to the present invention will be clearer and evident from the following description, exemplificative and non-limiting, of a form of embodiment of the invention with reference to the attached figures wherein.

DETAILED DESCRIPTION

Figure 1:
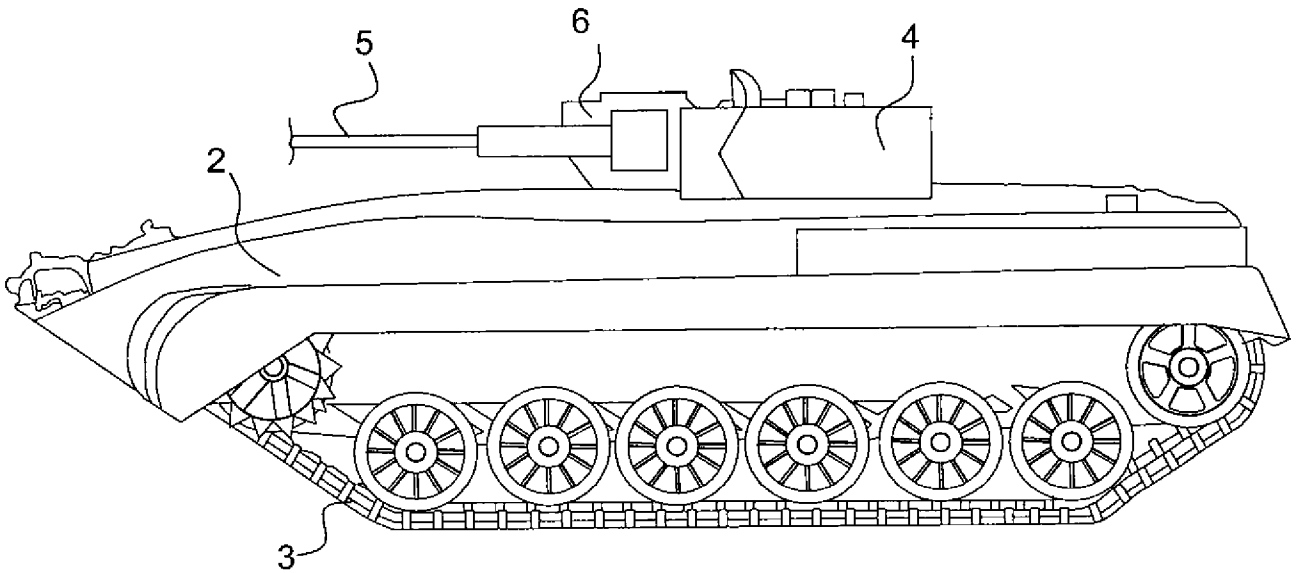
FIG. 1 shows a schematic view of the vehicle provided with revolving turret according to the present invention.
Figure 3A:
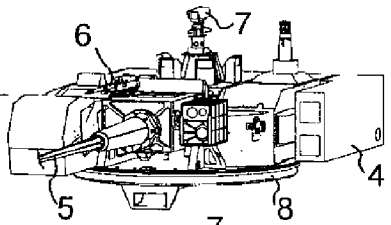
FIG. 3*a* shows a perspective schematic view of the turret according to the present invention.
Figure 3B:
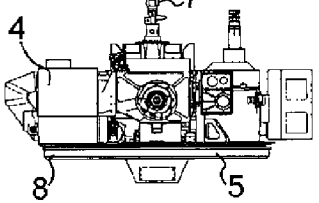
FIG. 3*b* shows a front schematic view of the turret according to the present invention.
Figure 3C:
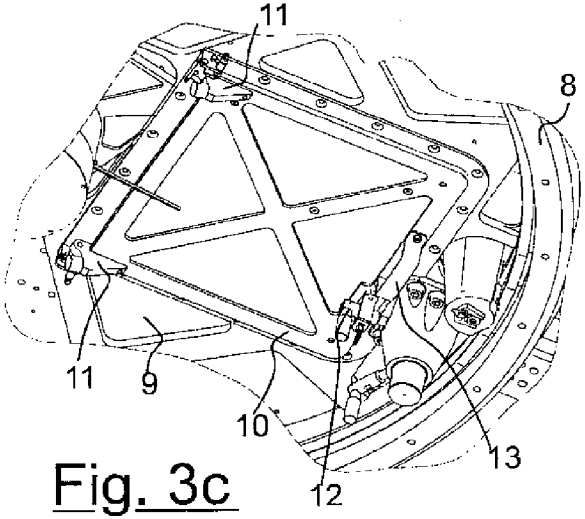
FIG. 3*c* shows a magnified particular of the turret in its lower part according to the present invention.
Figure 2A:
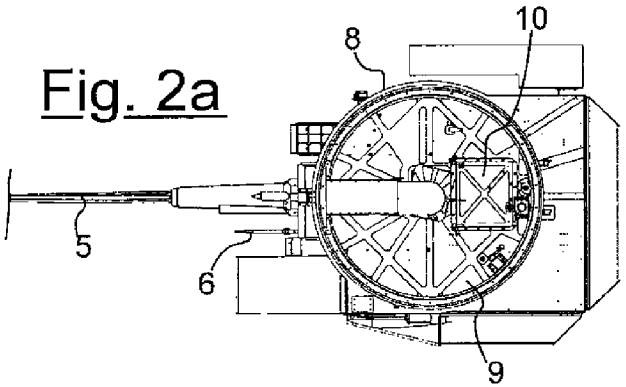
FIG. 2*a* shows a schematic view from the bottom of the turret according to the present invention.
Figure 2B:
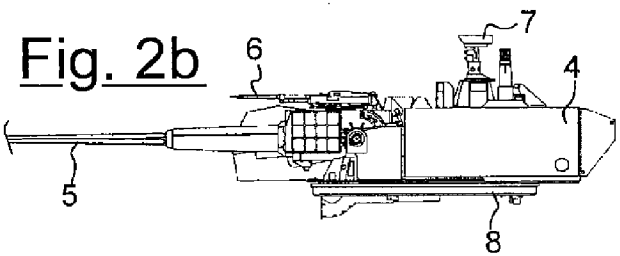
FIG. 2*b* shows a lateral schematic view of the turret according to the present invention.
Figure 2C:
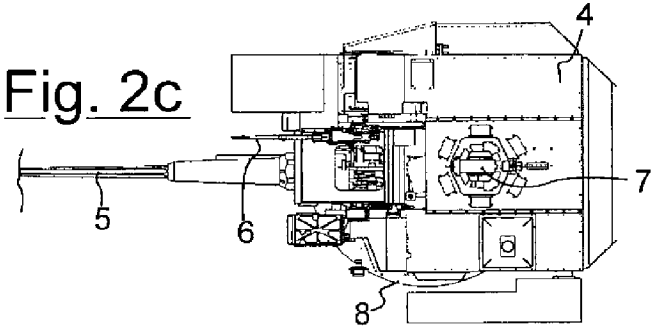
FIG. 2*c* shows a schematic view from the top of the turret according to the present invention.

With reference to the above mentioned figures the vehicle according to the present invention comprises an armor-plated cockpit 2 and preferably a track motion system 3 or alternatively rotated and is provided with a central revolving turret 4 upon which is mounted main armament 5 such as a cannon or another weapon or actuator.

The cannon can be provided with thermal sensors and usually has a system for the gas recovery and fire damping and is also hydraulically stabilized.

The turret is also usually provided with one or more machine guns 6 and with various pointing and vision systems, such as a stabilized night/day periscopic viewer 7 for the commander, a stabilized viewer with thermal view and laser telemeter for the gunner, apart from a fire controlling computer. The computer receives data from the various sensors of the vehicle and is able to process all the data for determining the best firing conditions.

The turret is connected to the armor-plated cockpit of the vehicle by a circumferential bearing 8 which allows the complete revolving (by 360°) of the turret with respect to a vertical axis passing through the center of the bearing.

According to the present invention, basis 9 of the turret includes a hatch 10 for communication between the interior of the turret where there are the controls for the main and auxiliary armaments, and the interior of cockpit 2 of the vehicle.

The hatch permits access to the turret not only from outside and from the top of the vehicle, as traditionally happens, but also by the personnel who is inside the cockpit of the vehicle, for the purpose of, for instance, looking through episcopes, refilling the ammunition chest, carrying out emergency shots, having another escape way from the cockpit of the vehicle and carrying out maintenance operations.

Preferably, this hatch opens at the bottom or basis of the turret toward the interior of the cockpit of the vehicle by opposed hinges 11.

Preferably, this hatch has a quadrangular or rectangular shape.

The hatch is also provided with a closure 12 and grasping handle 13 which are accessible from the interior of the cockpit of the vehicle.

The turret according to a peculiar characteristic of the present invention does not have parts which enter the hull or the cockpit of the vehicle. The only communication or connection element is hatch 10.

The invention claimed is:

1. A vehicle provided with a central revolving overhead turret, said vehicle comprising:

an armor-plated cockpit comprising an interior space;

an overhead turret, the turret having substantially no cockpit penetration, the turret being configured for mounting a main armament;

a system for moving the central revolving overhead turret, the system for moving the central revolving overhead turret comprising a circumferential bearing, said overhead turret comprising a base and being connected to the armor-plated cockpit by said circumferential bearing to allow revolving of the overhead turret around a substantially vertical axis passing through a center of said bearing, said base comprising a floor located completely external to the cockpit and a hatch attached to the floor by a pair of opposed hinges, wherein the hatch pivots about the hinges toward the interior space of the cockpit from a first position closing a passage in the floor to a second position providing communication between the overhead turret and the cockpit.

2. A vehicle according to claim 1, wherein said hatch has a quadrangular or rectangular shape.

3. A vehicle according to claim 1, wherein said hatch is provided with closure means and grasping means that are accessible from the cockpit.

4. A vehicle according to claim 1, wherein said vehicle comprises tracks.

5. A vehicle according to claim 1, wherein said vehicle comprises a fire controlling computer determining best firing conditions.

* * * * *